United States Patent [19]

Adkins et al.

[11] Patent Number: 4,497,445

[45] Date of Patent: Feb. 5, 1985

[54] DIFFUSION APPARATUS

[75] Inventors: Richard C. Adkins, Buckinghamshire; James O. Yost, Bristol, both of England

[73] Assignee: Rolls-Royce Limited, London, England

[21] Appl. No.: 540,102

[22] Filed: Oct. 7, 1983

Related U.S. Application Data

[63] Continuation of Ser. No. 241,419, Mar. 6, 1981, abandoned.

[30] Foreign Application Priority Data

Mar. 10, 1980 [GB] United Kingdom ..... 8008070

[51] Int. Cl.[3] ..... F02C 7/00

[52] U.S. Cl. ..... 239/590; 60/39.161; 60/751; 239/590.5

[58] Field of Search ..... 239/265.11, 265.19, 239/589-590.5; 60/39.161, 39.65, 751; 415/182, 207, 213 C

[56] References Cited

U.S. PATENT DOCUMENTS

| | | | |
|---|---|---|---|
| 2,841,182 | 7/1958 | Scala . | |
| 3,144,202 | 8/1964 | Helmbold . | |
| 3,216,455 | 11/1965 | Cornell et al. . | |
| 3,452,769 | 7/1969 | Jones et al. . | |
| 3,452,782 | 7/1969 | Scheper, Jr. . | |
| 4,098,073 | 7/1978 | Adkins et al. | 60/39.16 R |

FOREIGN PATENT DOCUMENTS

| | | |
|---|---|---|
| 1187432 | 2/1965 | Fed. Rep. of Germany . |
| 1210899 | 3/1960 | France . |
| 2345592 | 3/1977 | France . |
| 2390587 | 4/1978 | France . |
| 134244 | of 1977 | Japan . |
| 568170 | 3/1945 | United Kingdom . |
| 1084330 | 9/1967 | United Kingdom . |

OTHER PUBLICATIONS

Gunnar Heskestad: "Further Experiments With Suction at a Sudden Enlargement in a Pipe", Journal of Basic Engineering, Sep., 1970, pp. 437-449.

R. C. Adkins: "A Short Diffuser With Low Pressure Loss", Journal of Fluids Engineering, vol. 92, No. 3, Sep., 1975, pp. 437-449.

*Primary Examiner*—Andres Kashnikow

*Attorney, Agent, or Firm*—Parkhurst & Oliff

[57] ABSTRACT

A diffuser has an upstream duct, a downstream duct, the adjacent ends of the ducts defining a sudden enlargement of flow area. A fence arranged downstream of the downstream end of the upstream duct defines the upstream end of the downstream duct and has a free edge defining a flow area intermediate between that of defined by the adjacent ends of the two ducts. A chamber at the outside of the upstream duct has an opening defined by the downstream end of the upstream duct and the free edge of the fence. The ratio between the flow areas of the two ducts of their adjacent ends lies between 1.4 and a minimum greater than 1. The above ratio provides high diffuser effectiveness with little or no bleed from the chamber. Elements each comprising a diffuser as above may be arranged in flow-series to make possible a pressure rise greater than that given by a single element. A downstream one of the elements may have an area ratio greater than that of the preceding element(s) and its chamber may be connected by a bleed line to the upstream duct of one of the preceding elements, thereby to reduce the static pressure in the chamber and provide in respect of that downstream element, both a high area ratio and high effectiveness.

16 Claims, 7 Drawing Figures

DIFFUSION APPARATUS

DESCRIPTION

This is a continuation of application Ser. No. 241,419 filed Mar. 6, 1981, now abandoned.

This invention relates to diffusion apparatus.

A known diffuser has a cylindrical upstream duct leading to a cylindrical downstream duct of larger flow area, the adjacent ends of the ducts defining a sudden enlargement of flow area. An annular fence arranged a short distance downstream of the end of the upstream duct defines the beginning of the downstream duct. A chamber provided at the exterior of the upstream duct has an opening defined by the free edge of the fence and the downstream end of the upstream duct. The latter edge lies at a diameter intermediate between those of the two ducts. Flow from the upstream duct diffuses when passing across said opening and into the downstream duct, the diffusion being associated with vortices which form in the chamber adjacent said opening and immediately downstream of the fence. The rate of diffusion may be seen in terms of the relationship between the effectiveness of the diffuser, the area ratio of the diffuser and the effective length of the downstream duct. These terms are defined later herein. In said known diffuser, the rate of diffusion is improved by reducing the static pressure in said chamber by so-called "bleed" i.e. by connecting the chamber to a source of pressure lower than that at downstream end of the upstream duct. Such bleed constitutes a loss of fluid from the diffuser. This can be a serious disadvantage especially in diffusers in gas turbine engines where such loss reduces the power of the engine.

Research following the publication of said known diffuser has taken the direction of further increasing the bleed from the chamber and working with relatively high area ratios. This was based, in particular, on the finding that up to a certain amount of bleed there is no worthwhile improvement in diffusion rate but above that amount there is a dramatic improvement especially if the diffuser has a relatively high area ratio. However, an increase in bleed further increases said loss. It had therefore been proposed (U.S. Pat. No. 4,098,073) to arrange the upstream duct in the form of a conventional diffuser and connect the chamber to an upstream station thereof. The relatively lower pressure at said station then brings about the bleed flow and, since the bleed flow is returned into the upstream duct, there is no loss of fluid from the diffuser. However, it has been found that the pressure obtainable in this way at said station is often not sufficiently low to produce a worthwhile bleed unless the upstream duct is made of unacceptably great length.

The present invention is based on a reversal of the above direction of research in that it is based on an investigation of the effects of reducing, and possibly dispensing with, the bleed flow while bringing the diffuser design as a whole to its maximum effectiveness. As a result of this work it has been found that if the area ratio of the diffuser is reduced to certain relatively low levels, the effectiveness of the diffuser rises and a reduction in bleed flow has relatively little influence on the good effectiveness figures achieved in this way. As a result a worthwhile improvement in diffusion rate is obtainable even if the bleed flow is dispensed with completely.

According to this invention there is provided diffusion apparatus comprising an upstream duct, a downstream duct, the adjacent ends of the ducts defining a sudden enlargement of flow area, a fence arranged downstream of the downstream end of the upstream duct and defining the upstream end of the downstream duct, the fence having a free edge defining a flow area intermediate between that defined by the adjacent ends of the two ducts, a chamber provided at the outside of the upstream duct and having an opening defined by the downstream end of the upstream duct and the free edge of the fence, and wherein the area ratio of the ducts at said adjacent ends thereof lies between 1.4 and a minimum greater than 1.

Also according to this invention there is provided diffusion apparatus having at least two diffusion elements connected in flow series and each comprising an upstream duct, a downstream duct, the adjacent ends of the ducts defining a sudden enlargement of flow area, a fence arranged downstream of the downstream end of the upstream duct and defining the upstream end of the downstream duct, the fence having a free edge defining a flow area intermediate between that defined by said adjacent ends of the ducts, a chamber provided at the outside of the upstream duct and having an opening defined by the downstream end of the upstream duct and the free edge of the fence, and wherein in each said element the area ratio of the ducts at said adjacent ends thereof lies between 1.4 and a minimum greater than 1.

It has been found that said area ratio of 1.4 is, at least approximately, the value below which high effectiveness figures are possible with relatively little or even no bleed. Area ratios between 1.35 and 1.15, especially between 1.25 and 1.15, and particularly 1.2, have been found useful.

Apparatus comprising at least two said elements is useful in building up a static pressure rise greater than can be done by a single such element. The choice of said minimum area ratio is determined by balancing the improvement provided by a low area ratio in an individual said element against the cost of the number of elements necessary to build up a required static pressure.

Other aspects of this invention are described in the context of the following description of examples.

Examples of diffusing apparatus according to this invention will now be described with reference to the accompanying drawings wherein.

Figure 1:
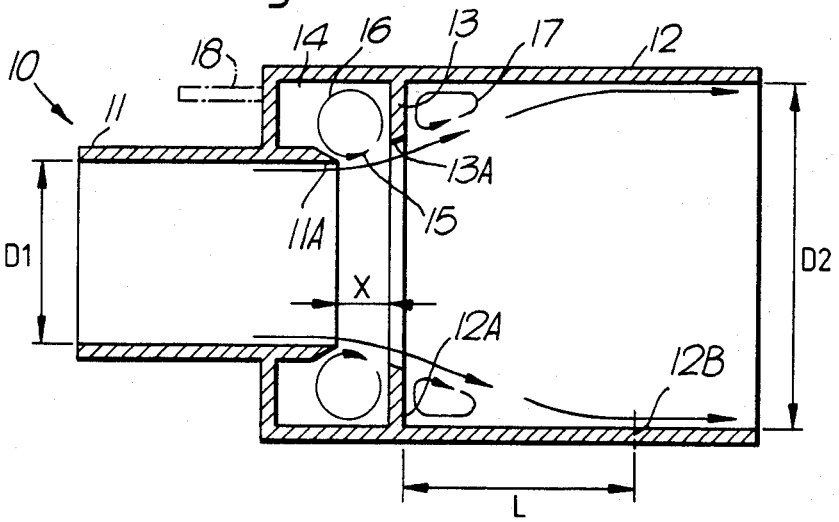
FIG. 1 is a sectional elevation of an unbled vortex-controlled diffuser (as defined later herein).

Referring to FIG. 1, the diffuser, denoted 10, comprises a cylindrical inlet duct 11 and a cylindrical outlet duct 12. The duct 12 has a diameter D2 greater than that, D1, of the duct 11, the ratio of the diameters D2/D1 determining the area ratio AR of the diffuser. The duct 11 has a downstream end 11A. The duct 12 has an upstream end 12A lying at the bottom of an annular fence 13 situated a short distance X downstream of the end 11A. The top edge, 13A, of the fence has a diameter intermediate between the diameters D1,D2. The end 11A and the edge 13A define an opening 15 to an annular chamber 14 situated at the outside of the duct 11. In operation flow across the opening 15 creates in the chamber 14 a vortex 16 causing the flow to diffuse. Further diffusion takes place downstream of the fence 13 and is associated with a second vortex 17. Diffusion ends a certain distance downstream of the fence 13 at, what is, the effective end 12B of the duct 12. It has been found convenient to regard the length of the diffuser as an axial distance L between the ends 12A,12B of the duct 12 although diffusion actually extends over the distance L+X. However, the distance X is so small in relation to the distance L as to be negligable.

The diffuser 10 is essentially defined by the sudden enlargement of flow area between the ends 11A,12A, the fence 13, and the chamber 14 with its opening 15, all proportioned to produce the vortices 16,17. Such a diffuser is hereinafter referred to as a "vortex-controlled diffuser".

Figure 2:
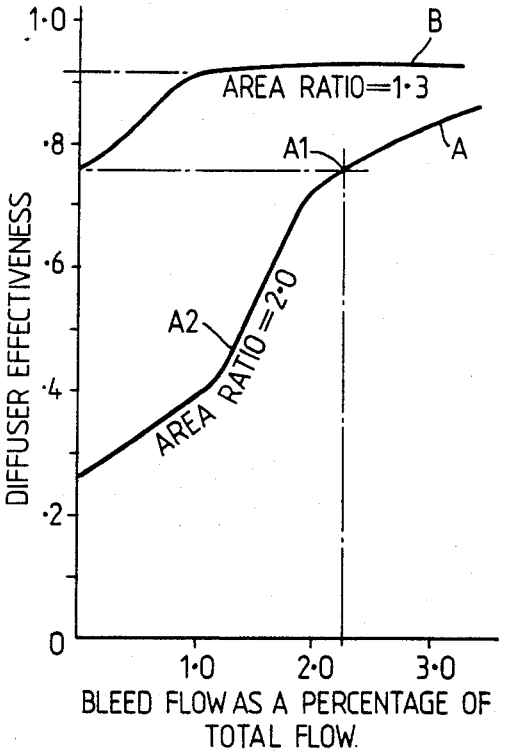
FIG. 2 shows curves pertaining to the diffuser shown in FIG. 1.

It is known to improve the effectiveness of a vortex-controlled diffuser by lowering the static pressure in the chamber 14 by a so-called "bleed" e.g. through a duct 18. In FIG. 2, effectiveness of the diffuser is plotted against bleed, the latter being in terms of a percentage of total flow through the duct 10. Effectiveness is defined as the coefficient of static pressure recovery (Cp) of an actual diffuser compared to that of an ideal diffuser. Curve A shows the characteristic of the diffuser at an area ratio of 2.0 and illustrates that effectiveness of the diffuser drops sharply with a reduction of bleed between points A1,A2 so that the diffuser would not be regarded as useful at a bleed of less than 2%.

Experiments made to investigate the effect of lowering the area ratio revealed two features. Firstly, the loss of effectiveness with a reduction in bleed is much less marked at the lower area ratios, i.e. it tends to remain more nearly uniform regardless of bleed. Curve B of FIG. 2 shows the characteristic of the diffuser at an area ratio of 1.3 and reveals that the loss of effectiveness with a reduction in bleed is so small that even at zero bleed the effectiveness is as good (over 70%) as for an area ratio of 2.0 (curve A) at over 2% bleed. Secondly, if the area ratio is lowered the effectiveness rises at all percentages of bleed. Curves A,B show that for 2.2% bleed a lowering of the area ratio from 2.0 to 1.3 results in a rise of effectiveness from 0.76 to over 0.9. At 1% bleed when the effectiveness at curve A has fallen to 0.4, that at curve B is still above 0.9. But even more noteworthy is that at zero bleed, where the AR=2.0 effectiveness is about 0.25, the effectiveness at AR=1.3 is still usefully high at 0.76. These improvements in effectiveness, which become noticable below an area ratio of about 1.4, highlight the advantages of the zero bleed condition albeit at a limitation of area ratio.

Figure 3:
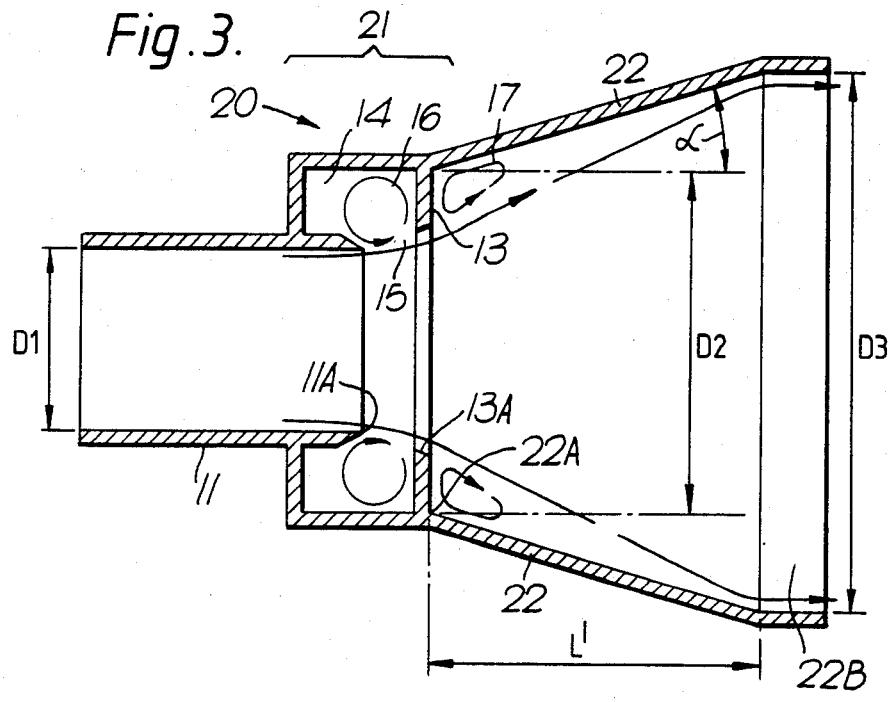
FIG. 3 is a sectional elevation of an unbled hybrid diffuser (as defined later herein).
Figure 4:
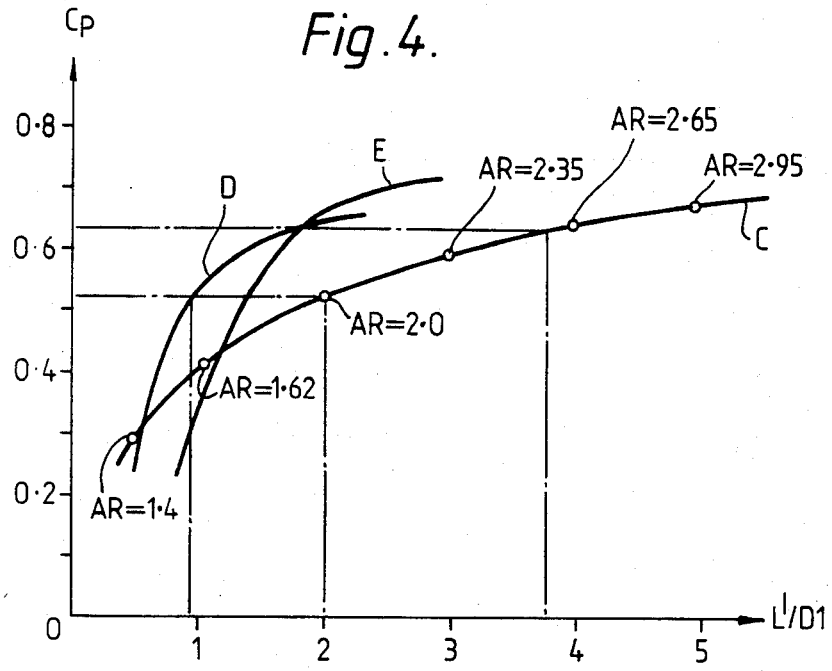
FIGS. 4 and 5 show curves pertaining to the diffuser shown in FIG. 3.

However, larger area ratios can be achieved by providing a vortex-controlled diffuser of zero bleed and AR∠1.4 with an outlet duct 22 which is divergent at an angle equal to or greater than that of a conventional conical diffuser. This combination is referred to as a "hybrid diffuser" and is shown, denoted 20, in FIG. 3. The area ratio of the vortex component 21 of the hybrid diffuser is given by the rise of the diameters D1,D2 between the end 11A of the duct 11 and the start, denoted 22A, of the duct 22, and is still less than 1.4, while the downstream end, 22B, of the duct 22 has a diameter D3>D2 corresponding to an angle of divergence $\alpha$. The overall area ratio of the hybrid diffuser corresponds to the relationship of the diameters D3,D1. The hybrid diffuser has been found to have an effectiveness sufficiently good at overall area ratios ≧2.0 to make possible a length L′ significantly less than that of a conventional conical diffuser of corresponding area ratios. In FIG. 4 the static pressure rise coefficient Cp is plotted against the non-dimensional length L′/D1. Curve C shows the characteristic for a conventional conical diffuser, known as a "Cp* diffuser", whose area ratios have been optimized to give maximum values of Cp for specified lengths. Curve D shows the characteristic for a hybrid diffuser having a vortex component of AR=1.2 and an overall AR=2.0, and illustrates that, for the same value of Cp, the hybrid diffuser has about half the length of the conventional diffuser. Curve E shows the characteristic of a hybrid diffuser whose vortex component again has AR=1.2 but whose overall AR=2.5. Here, again the length requirement of the hybrid diffuser is about half that of the conventional diffuser. Worthwhile effectiveness figures have been obtained with overall area ratios of up to 3.5. The lowest overall ratio which one would employ in the present context is somewhat above 1.4, say 1.5.

Figure 5:
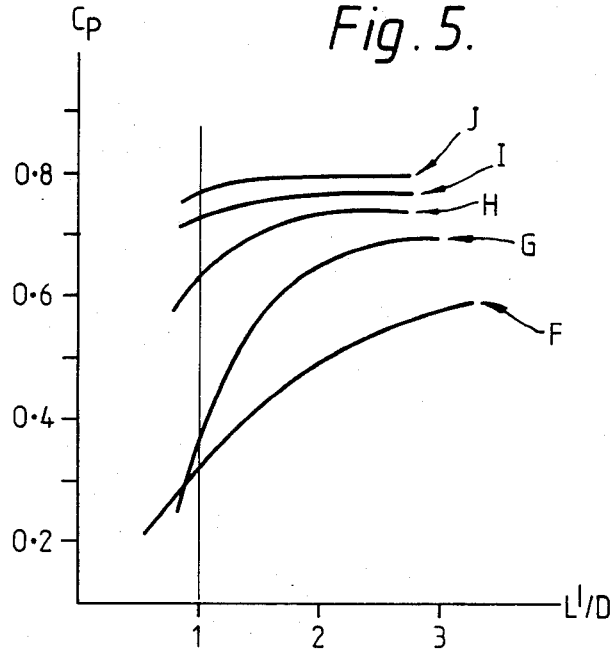

Experiments were also made with hybrid diffusers whose vortex chambers were bled. The effectiveness of such an arrangement is shown in FIG. 5 where Cp is plotted against L′/D1 and where is shown a curve F for a Cp* conventional diffuser of AR=2.5, and curves, G,H,I and J for a hybrid diffuser having an overall AR=2.5 but at 0,1,2 and 3% bleed respectively. Curve J shows that at 3% bleed, the static pressure rise coefficient Cp of the hybrid diffuser remains high at 0.8 right back to L′/D1=1 i.e. the flow area of the diffuser may increase 2.5 times over a length L′ equal to the inlet diameter D1 with Cp remaining at 0.8.

Figure 6:
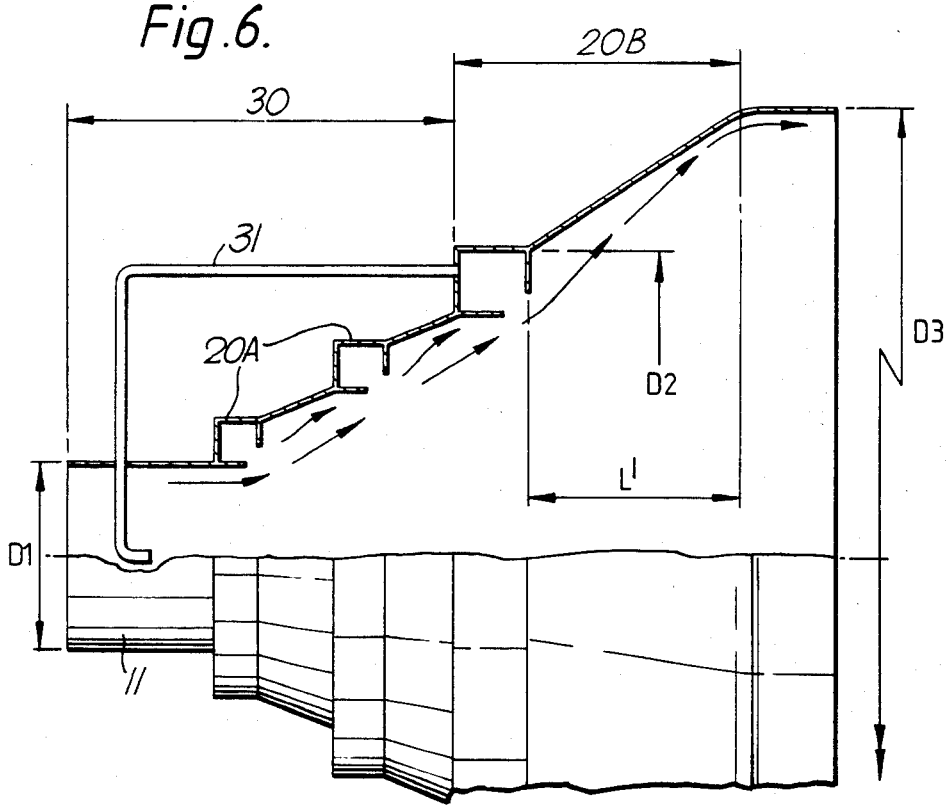
FIG. 6 is a sectional elevation of diffusing apparatus being a combination of an array of unbled vortex-controlled diffusers and a bled hybrid diffuser.

The good properties of the bled hybrid diffuser can be exploited advantageously in diffusion apparatus shown in FIG. 6 and comprising an array 30 of in-series hybrid diffuser elements 20A of progressively increasing diameters and followed in series by a hybrid diffuser 20B. The elements 20A are each a diffuser similar to the diffuser 20 described with reference to FIG. 3, each element having an overall AR of say 1.8. The outlet duct of any one element 20A is the inlet duct of the next following element, the downstream element being of larger flow are than that of the preceding element. The hybrid diffuser 20B is similar to that described with reference to FIG. 3 and has a vortex-controlled component of AR=1.2 and an overall AR=2.5. The array of the highly effective elements 20A soon builds up a static pressure at the inlet to the diffuser 20B sufficiently high over the pressure in the inlet duct 11 of the first element 20A to make it possible to energise a bleed flow by a duct 31 from the vortex chamber of the diffuser 20B to the duct 11 of the first element 20A. In this way one can have the advantages of a bled hybrid diffuser without loss of flow medium.

Figure 7:
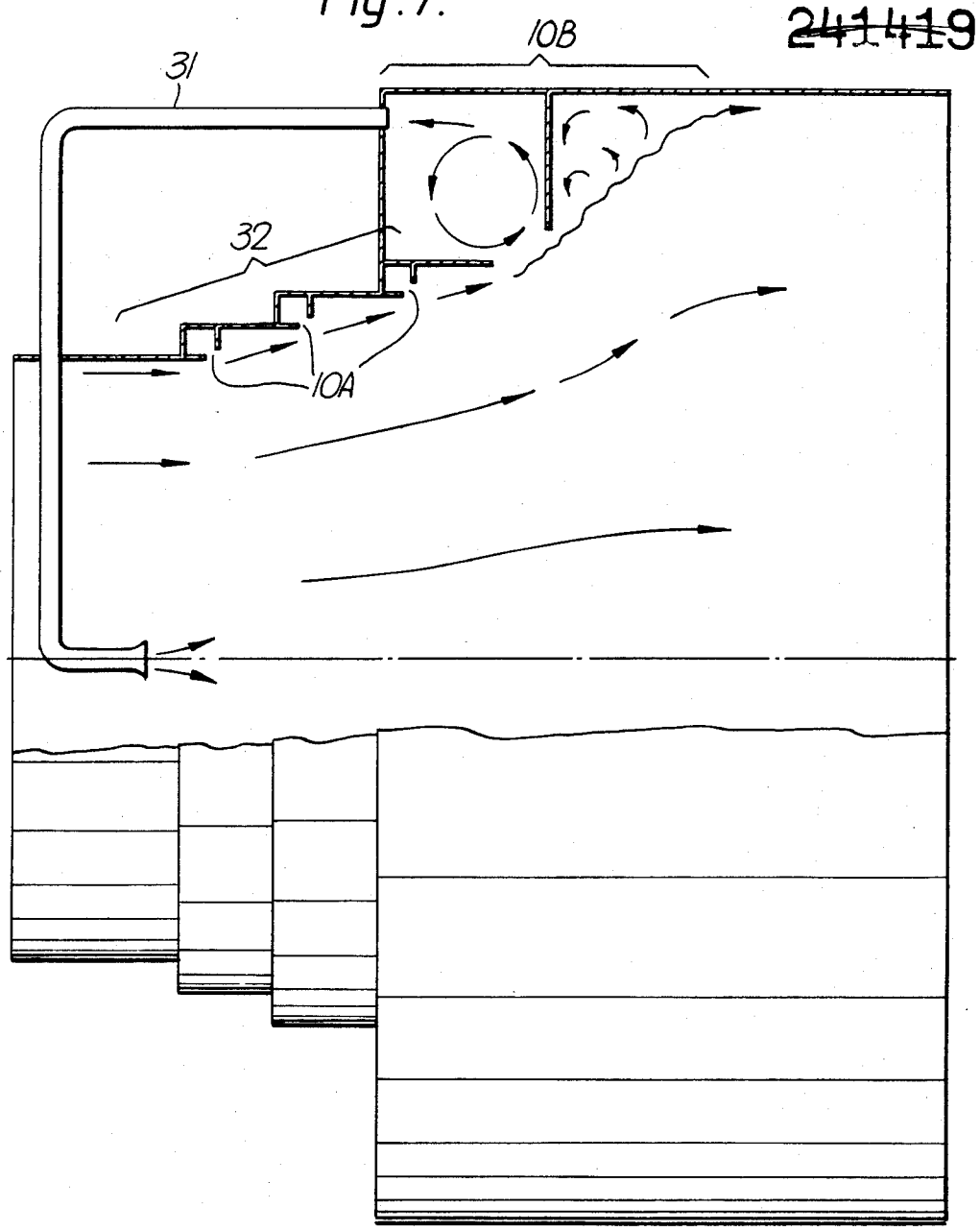
FIG. 7 is a sectional elevation of diffusing apparatus comprising a combination of unbled and bled vortex-controlled diffusers.

FIG. 7 shows diffusion apparatus comprising an array 31 similar to that described with reference to FIG. 6 but comprising vortex-controlled diffuser elements 10A of area ratio 1.2 followed by a vortex-controlled diffuser 10B having an AR=2.0. As was apparent from curve A of FIG. 2, a vortex-controlled diffuser of the latter AR requires substantial bleed for high effectiveness. As in FIG. 6 so also here, such bleed is made possible by the high static pressure created by the array 31 so that the bleed flow can be energised by the pressure drop between the vortex chamber of the diffuser 10B and the inlet duct of the first element 10A.

The apparatus illustrated in FIGS. 1,3,6,7 pertains to diffusion of air. The drawings are not necessarily to scale and the flow lines are diagrammatic.

The area ratios of the elements 20A or 10A may increase progressively in the direction of flow. A relatively large number of such elements may be used, the benefit being generally the greater the smaller the area ratios of the respective elements. In practice the number of elements is limited by cost and a certain diminution of benefit as an unavoidable degree of general turbulence develops.

In connection with the angle $\alpha$ of divergence (FIG. 3) of the downstream duct 22 of the hybrid diffuser being greater than that of a conventional conical diffuser, it is explained that in the latter diffuser the angle of divergence is limited by occurance of boundary layer separation at the wall of the diffuser, whereas in the hybrid diffuser described the angle can be made greater than that at which boundary layer separation would normally occur in the conventional diffuser. This aspect is explained in detail in said U.S. Pat. No. 4,098,073. It may be added that the flow mechanism during boundary layer separation may vary and may include a certain amount of reverse flow of the air along the wall. However, in practice, a comparison can be made between the conventional and the hybrid diffuser on the basis of effectiveness. In the conventional diffuser the effectiveness falls with the onset of boundary layer separation when a critical value of L'/D1 (FIG. 4) is exceeded. In the hybrid diffuser, a corresponding fall of effectiveness occurs at a lower value of L'/D1.

What is claimed is:

1. Diffusion apparatus comprising an upstream duct, a downstream duct, the adjacent ends of the ducts defining a sudden enlargement of flow area, a fence arranged downstream of the downstream end of the upstream duct and defining the upstream end of the downstream duct, the fence having a free edge defining a flow area intermediate between that defined by the adjacent ends of the two ducts, a chamber provided at the outside of the upstream duct and having an opening defined by the downstream end of the upstream duct and the free edge of the fence, the chamber having a bleed flow rate of less than 5 percent, and wherein the area ratio of the ducts at said adjacent ends thereof lies between 1.4 and a minimum greater than 1.

2. Diffusion apparatus having at least two diffusion elements connected in flow series and each comprising an upstream duct, a downstream duct, the adjacent ends of the ducts defining a sudden enlargement of flow area, a fence arranged downstream of the downstream end of the upstream duct and defining the upstream end of the downstream duct, the fence having a free edge defining a flow area intermediate between that defined by said adjacent ends of the ducts, a chamber provided at the outside of the upstream duct and having an opening defined by the downstream end of the upstream duct and the free edge of the fence, at least one of said chambers having substantially no bleed flow drawn therefrom, and wherein in each said element the area ratio of the ducts at said adjacent ends thereof lies between 1.4 and a minimum greater than 1.

3. Apparatus according to claim 1 or claim 2 wherein said area ratio lies between 1.4 and 1.1.

4. Apparatus according to claim 3 wherein said area ratio lies between 1.35 and 1.15.

5. Apparatus according to claim 4 wherein said area ratio lies between 1.25 and 1.15.

6. Apparatus according to either of claims 1 or 2 wherein no bleed flow is taken from any said chamber.

7. Apparatus according to claim 1, wherein the walls of the downstream duct are parallel.

8. Apparatus according to claim 2 wherein the walls of the downstream ducts of the respective elements are divergent.

9. Apparatus according to claim 1 wherein the downstream duct is divergent at an angle greater than that at which boundary layer separation would normally occur in a conventional conical diffuser.

10. Apparatus according to claim 2 wherein the downstream duct of the respective said elements are divergent at an angle greater than that at which boundary layer separation would normally occur in a conventional conical diffuser.

11. Apparatus according to claim 9 wherein the area ratio between the downstream end of the downstream duct and the downstream end of the upstream duct lies between 1.5 and 3.5.

12. Apparatus according to any one of claims 2, 8 or 10 wherein the last one of the elements (as seen in the direction of flow) has an area ratio of the ducts at said adjacent ends thereof greater than 1.4.

13. Apparatus according to claim 12 wherein the chamber of said last element is connected to a source of static pressure lower than that at the downstream end of the upstream duct of said last element.

14. Apparatus according to claim 13 wherein said source of lower static pressure is the upstream duct of the or a preceding said element.

15. The diffuser as recited in claim 1, wherein the chamber has a bleed flow rate of less than 3 percent.

16. The diffuser as recited in claim 1, wherein the chamber has a bleed flow rate of less than 2.2 percent.

* * * * *